US012108852B1

(12) United States Patent
Butler

(10) Patent No.: US 12,108,852 B1
(45) Date of Patent: Oct. 8, 2024

(54) INSULATED LUNCH BAG

(71) Applicant: Neko Butler, Silver Springs, MD (US)

(72) Inventor: Neko Butler, Silver Springs, MD (US)

( * ) Notice: Subject to any disclaimer, the term of this patent is extended or adjusted under 35 U.S.C. 154(b) by 90 days.

(21) Appl. No.: 17/975,079

(22) Filed: Oct. 27, 2022

(51) Int. Cl.

| | |
|---|---|
| ***A45C 11/20*** | (2006.01) |
| ***A45C 13/02*** | (2006.01) |
| ***A45C 13/10*** | (2006.01) |
| ***B65D 81/38*** | (2006.01) |

(52) U.S. Cl.
CPC ..... *A45C 11/20* (2013.01); *A45C 13/02* (2013.01); *A45C 13/103* (2013.01); *B65D 81/3888* (2013.01)

(58) Field of Classification Search
CPC ..... F25D 3/08; F25D 2331/801; F25D 2303/0843; F25D 2303/0822; A45C 11/20; A45C 13/02; A45C 13/103; A45C 7/0077
USPC ..... 220/592.2, 915.2; 62/457.2, 457.7, 62/457.5; 383/110, 38, 40
See application file for complete search history.

(56) References Cited

U.S. PATENT DOCUMENTS

| | | | | |
|---|---|---|---|---|
| 8,573,002 | B2 | 11/2013 | Ledoux | |
| 9,265,318 | B1 * | 2/2016 | Williams | A45C 11/20 |
| 9,498,036 | B1 | 11/2016 | Pellegrin | |
| 2004/0035143 | A1 * | 2/2004 | Mogil | A45C 13/02 383/110 |

* cited by examiner

*Primary Examiner* — King M Chu
(74) *Attorney, Agent, or Firm* — Sanchelima & Associates, P.A.; Christian Sanchelima; Jesus Sanchelima

(57) ABSTRACT

An insulated lunch bag including a housing assembly, a lower compartment assembly and an upper compartment assembly. The housing assembly includes a housing and a handle, the handle can be used to carry the handle. The lower compartment assembly and the upper compartment assembly are inside of the housing and separated a predetermined distance. The lower compartment assembly is beneath the upper compartment assembly. The lower compartment assembly and the upper compartment assembly can be used to store food items therein and are accessed through zippers. The lower compartment assembly and the upper compartment assembly have heat isolation.

8 Claims, 5 Drawing Sheets

INSULATED LUNCH BAG

BACKGROUND OF THE INVENTION

1. Field of the Invention

The present invention relates to an insulated lunch bag and, more particularly, to an insulated lunch bag that has a compartment specially insulated for keeping food hot and another compartment to keep the food cold.

2. Description of the Related Art

Several designs for lunch bags have been designed in the past. None of them, however, include a plurality of insulated materials for keeping hot or cold the food stored therein.

Applicant believes that a related reference corresponds to U.S. Pat. No. 9,498,036 issued for a carrying kit which is used to maintain foodstuff at a desired temperature which has a divide unit and hot/cold packs. Applicant believes that another related reference corresponds to U.S. Pat. No. 8,573,002 issued for a portable cooler with a plurality of compartments for holding food and drink items while keeping them cold. None of these references, however, teach of a soft sided bag assembly with handles and an insulated internal divider which allows the user to carry both hot and cold food items in separate compartments while still maintaining the temperature of the food items.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an insulated lunch bag that includes a handle to easily carry the lunch bag.

It is another object of this invention to provide an insulated lunch bag that includes two compartments which are accessible through a zipper.

It is still another object of the present invention to provide an insulated lunch bag that includes a housing having a soft outer surface and an insulated inner surface.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
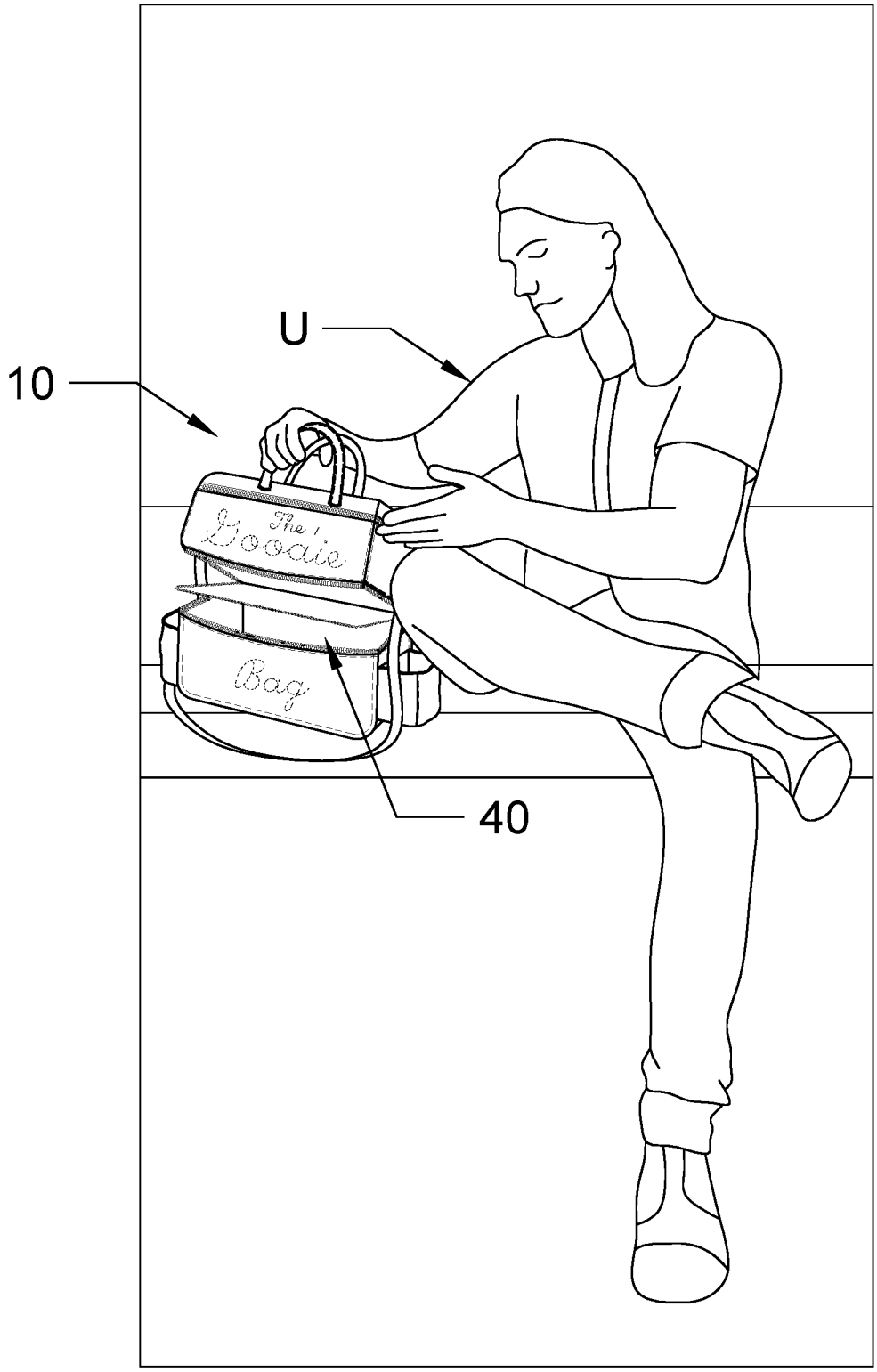
FIG. 1 represents an isometric operational view of the present invention 10. The user U is accessing the lower compartment assembly 40.
Figure 2:
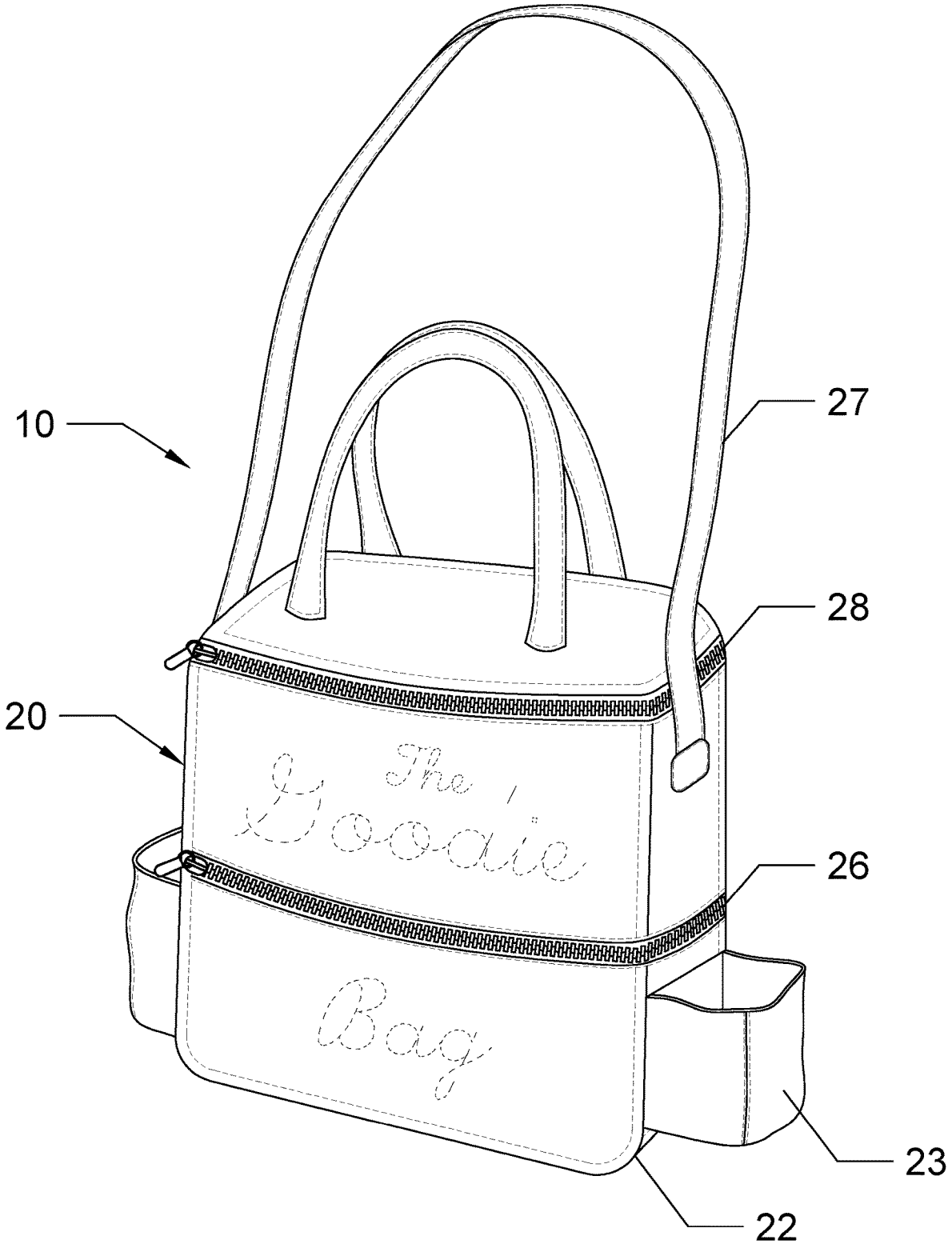
FIG. 2 shows an isometric view of the present invention 10 in a closed configuration.

Referring now to the drawings, where the present invention is generally referred to with numeral 10, it can be observed that it basically includes a housing assembly 20, a lower compartment assembly 40 and an upper compartment assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

As best illustrated in FIG. 1, the housing assembly 20 may include a housing 22, a handle 24, a belt 27, at least one holder 23, a lower zipper 26, a central zipper 21, and an upper zipper 28. The housing 22 may substantially have a cuboid elongated shape. It also may be suitable for the housing 22 to have a cylindrical shape, a hemispherical shape, or any other suitable shape. In a preferred embodiment the housing 22 may be made of a waterproof fabric such as vinyl, polyurethane laminate, thermoplastic polyurethane or any other suitable fabric known in the prior art. It also may be suitable for the housing 22 to be made of metal, leather, or any other suitable material. The housing 22 may be hollow. The housing 22 may have indicia to illustrate a trademark, a name, or any other text.

The handle 24 may be located on an uppermost end of the housing 22. It also may be suitable for the handle 24 to have any other configuration in the housing 22. The handle 24 may be used to hold and carry the present invention 10. In a preferred embodiment the handle 24 may include two semicircular elements protruding from the uppermost end of the housing 22. The handle 24 may be made of a waterproof fabric such as vinyl, polyurethane laminate, thermoplastic polyurethane or any other suitable fabric known in the prior art. It also may be suitable for the handle 24 to be made of metal, leather, or any other suitable material. The belt 27 may be attached to a top portion of the housing 22. The belt 27 may be a cross body belt. The belt 27 may be made of plastic, leather, or any other suitable material. The belt 27 may be adjustable in length.

The at least one holder 23 may be located on the lateral sides of the housing 22. It also may be suitable for the at least one holder 23 to have any other configuration in the housing 22. The at least one holder 23 may be made of an elastic material. The at least one holder 23 may be made of plastic, fabric, meta, or any other suitable material. The at least one holder 23 may be used to hold a bottle, a can, a container or any other suitable element. In a preferred embodiment the at least one holder 23 may include two holders 23 protruding from a right and left portion of the housing 22.

The lower zipper 26, the central zipper 21, and the upper zipper 28 may extend in the periphery of the housing 22. The lower zipper 26 may extend along a middle portion of the housing 22. The upper zipper 28 may extend along a top portion of the housing 22. The central zipper 21 may be located inside of the housing 22. The upper zipper 28 may be opened to access to the upper compartment assembly 60. The lower zipper 28 and the central zipper 21 may be opened to access to the lower compartment assembly 40.

The lower compartment assembly 40 may include a lower compartment 44, lower covering 42 and a lower division 46. The lower division 46 may have a central zipper 41. The lower compartment 44 may be a lower portion of the housing 22. The lower compartment 44 may have a bottom wall, a right wall, a front wall, a left wall and a rear wall. The lower compartment 44 may be used to store hot food items therein. The lower compartment 44 may have lower covering 42. The lower covering 42 may be heat threaded. The lower covering 42 may be made of fiberglass, ceramic fibers, vinyl, or any other material known in the prior art for heat insulation. It also may be suitable for the lower covering to be made of wool, vinyl or any other fabric having silica aerogel, resin bonded slab or any other suitable material. The lower covering 42 may be made of a waterproof material.

Figure 3:
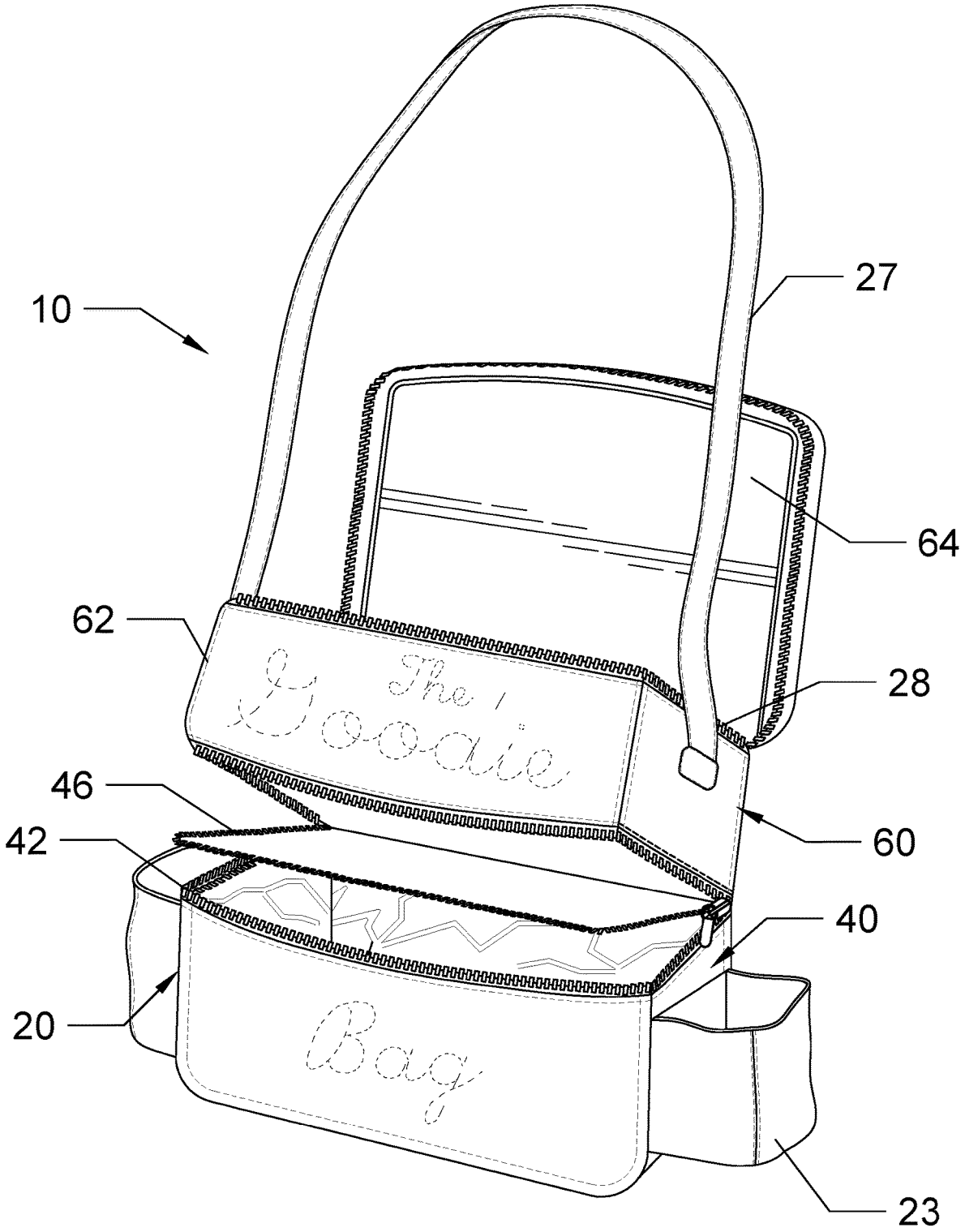
FIG. 3 illustrates an isometric view of the present invention 10 in an open configuration. The present invention includes a housing assembly 20, a lower compartment assembly 40 and an upper compartment assembly 60.

The lower division 46 may be the top wall of the lower compartment 44. The lower division 46 may extend along a central portion of the housing 22 and along a top opening of the lower compartment 44. As best shown in FIG. 3 the lower division 46 may be removed from the lower compartment 44 by opening the central zipper 21. The lower division 46 may be made of a waterproof fabric such as vinyl, polyurethane laminate, thermoplastic polyurethane or any other suitable fabric known in the prior art.

The upper compartment assembly 60 may include an upper compartment 64, upper covering 62, an upper division 66 and a top portion 68. The upper compartment 64 may be an upper portion of the housing 22. The upper compartment 64 may have a bottom wall, a right wall, a front wall, a left wall and a rear wall. The upper compartment 64 may be used to store cold food items therein. The upper compartment 64 may have upper covering 62. The upper covering 62 may be made of polyurethane forma, vinyl, rubber foam, or any other material known in the prior art for cold insulation. The upper covering 62 may be made of a waterproof material.

The upper division 66 may be the bottom wall of the upper compartment 64. The upper division 66 may extend along a central portion of the housing 22 and over the lower division 46. As best illustrated in FIG. 5 the lower division 46 and the upper division 66 may be separated a predetermined distance. The lower division 46 may be made of a waterproof fabric such as vinyl, polyurethane laminate, thermoplastic polyurethane or any other suitable fabric known in the prior art.

Figure 3A:
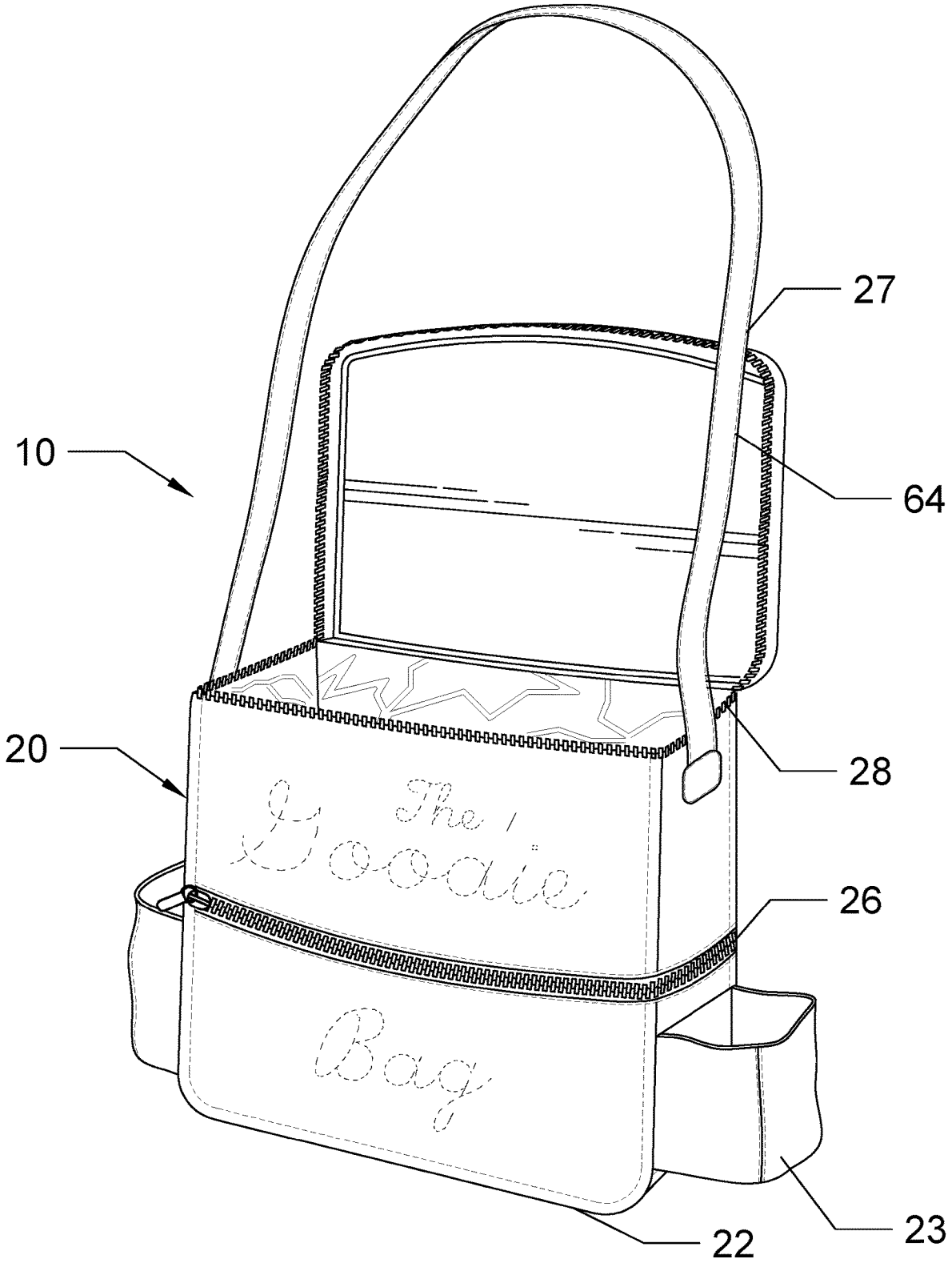
FIG. 3A shows an isometric view of the present invention 10 having the upper compartment 64 open.
Figure 4:
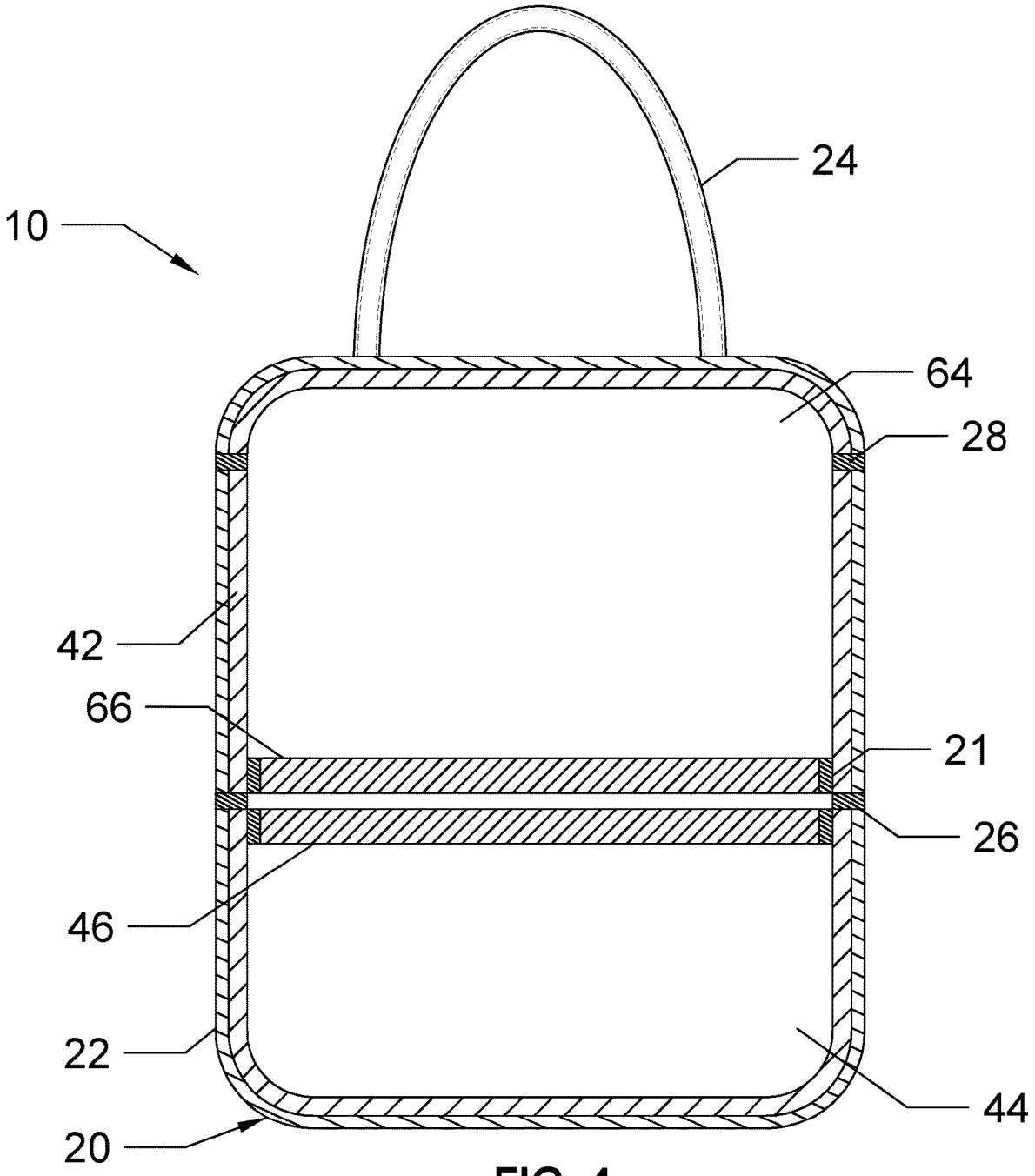
FIG. 4 shows a cross sectional view of the present invention 10.

As best shown in FIG. 3A the top portion 68 may be removed from the upper compartment 64 by opening the upper zipper 28. The top portion 68 may be located on a top portion of the housing 22. In a preferred embodiment the lower zipper 26 may be separated from the bottom wall of the lower compartment 64 a same distance as a separation between the upper division 66 and the upper zipper 28. The upper compartment 64 may have the same height, width and length as the lower compartment 44. The upper compartment 64 may be used to store and keep cold a cold food item. The lower compartment 44 may be used to store and keep warm a hot food item. The upper compartment 64 and the lower 44 may be inside of the housing 22 and separated a predetermined distance thereinto.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An insulated lunch bag, comprising:

a housing assembly, wherein said housing assembly includes a housing, two holders and two handles, said two handles are attached to said housing, wherein said housing is made of a waterproof material, wherein a first of the two holders protrudes from a right portion of the housing, wherein a second of said two holders protrudes from a left portion of the housing, each of the two holders has a rectangular opening;

a lower compartment assembly, wherein said lower compartment includes a lower compartment, said lower compartment is inside of said housing, said lower compartment having insulation; and an upper compartment assembly, wherein said upper compartment assembly includes an upper compartment, an upper zipper, and an upper portion, said upper portion is a top cover, said upper portion covers said upper compartment, said upper zipper is capable of opening said upper portion to access to said upper compartment, said upper portion has a flat rectangular shape, said upper compartment has a cuboid shape, said upper compartment is inside of said housing, said lower compartment is beneath said upper compartment, said upper compartment having insulation, wherein said lower compartment and said upper compartment are adapted to store food items therein.

2. The insulated lunch bag set forth in claim 1, wherein said housing has a lower zipper, said lower zipper extends a periphery of said housing.

3. The insulated lunch bag set forth in claim 2, wherein said lower zipper is located on a central portion of the housing, said lower zipper is capable of being opened to access to said lower compartment.

4. The insulated lunch bag set forth in claim 1, wherein said lower compartment has a lower division, the lower division is a top wall of said lower compartment, said lower division has a central zipper.

5. The insulated lunch bag set forth in claim 4, wherein said lower compartment is covered by means of said lower division, said lower division is removed by opening said central zipper.

6. The insulated lunch bag set forth in claim 1, wherein said lower compartment and said upper compartment are separated a predetermined distance inside of said housing.

7. An insulated lunch bag, comprising:

a housing assembly, wherein said housing assembly includes a housing, two holders, and a handle, said handle attached to said housing, wherein said housing is made of a waterproof material, wherein a first of the two holders protrudes from a right portion of the housing, wherein a second of said two holders protrudes from a left portion of the housing each of the two holders has a rectangular opening;

a lower compartment assembly, wherein said lower compartment includes a lower compartment, said lower compartment has a bottom wall, a top wall, a front wall, a rear wall, a right wall, and a left wall, wherein said top wall is a lower division, said lower division has a central zipper, said central zipper is opened to access to said lower compartment, said lower compartment is inside of said housing, said lower compartment having heat insulation, said lower compartment is adapted to store hot food items therein; and an upper compartment assembly, wherein said upper compartment assembly includes an upper compartment, said upper compartment has an upper portion, said upper portion has a flat rectangular shape, said upper portion covers said upper compartment, said upper portion is connected to said upper compartment by means of an upper zipper, said upper compartment is accessed by opening said upper zipper, said upper compartment is inside of said housing, said lower compartment is beneath said upper compartment, said upper compartment having insulation, wherein said upper compartment is adapted to store cold food items therein.

8. An insulated lunch bag, consisting of:

a housing assembly, wherein said housing assembly includes a housing, at two holders, a belt, and two handles, wherein a first of the two holders protrudes from a right portion of the housing wherein a second of said two holders protrudes from a left portion of the housing, each of the two holders has a rectangular opening, wherein said two holders are capable of store a bottle therein, said two handles are attached to said housing, wherein said housing is made of a waterproof material, said housing having a lower zipper, wherein said belt is attached to said housing, wherein belt extends from said housing;

a lower compartment assembly, wherein said lower compartment includes a lower compartment, said lower compartment has a bottom wall, a top wall, a front wall, a rear wall, a right wall, and a left wall, wherein said top wall is a lower division, said lower division has a central zipper, said central zipper is opened to access to said lower compartment, wherein said lower zipper is opened to access to said top wall of said lower compartment, said lower compartment is inside of said housing, said lower compartment having heat insulation, said lower compartment is adapted to store hot food items therein; and an upper compartment assembly, wherein said upper compartment assembly includes an upper compartment, said upper compartment has an upper portion, said upper portion has a flat rectangular shape, said upper portion covers said upper compartment, said upper portion is connected to said upper compartment by means of an upper zipper, said upper compartment is accessed by opening said upper zipper, said upper compartment is inside of said housing, said lower compartment is beneath said upper compartment, said upper compartment having insulation, wherein said upper compartment is adapted to store cold food items therein, wherein said lower compartment and said upper compartment are separated a predetermined distance inside of said housing.

* * * * *